United States Patent [19]

Mandilaras

[11] 4,030,193

[45] June 21, 1977

[54] HAIRCUTTING MACHINE

[76] Inventor: Stephen Emmanuel Mandilaras, 31 Brilisou St., Turkovounia Athens 703, Greece

[22] Filed: July 18, 1975

[21] Appl. No.: 597,159

Related U.S. Application Data

[63] Continuation of Ser. No. 330,740, Feb. 8, 1973, abandoned.

[30] Foreign Application Priority Data

Feb. 12, 1972 Greece ..... 47476

[52] U.S. Cl. ..... 30/30; 30/50; 30/54; 30/77

[51] Int. Cl.² ..... B26B 21/12; B26B 21/22

[58] Field of Search ..... 30/30, 31, 50, 51, 54, 30/63, 65, 71, 72, 77, 75, 81, 82, 84, 85, 87, 88, 89, 195

[56] References Cited

UNITED STATES PATENTS

| | | | |
|---|---|---|---|
| 816,141 | 3/1906 | Wiesenfeld | 30/77 X |
| 1,333,306 | 3/1920 | Gill | 30/77 X |
| 1,923,673 | 8/1933 | Jones | 30/50 |
| 1,951,775 | 3/1934 | Seilaz | 30/30 |
| 2,718,693 | 9/1955 | Gent | 30/54 X |
| 2,731,717 | 1/1956 | Spanel | 30/31 |
| 2,896,320 | 7/1959 | Caplan | 30/30 |
| 3,523,364 | 8/1970 | Crisanti | 30/30 |

*Primary Examiner*—Gary L. Smith
*Attorney, Agent, or Firm*—Raymond A. Robic; Francis B. Francois; Arthur Schwartz

[57] ABSTRACT

A haircutting machine by which a haircut may be performed without need of help from another person or a hairdresser in executing the work. The haircut is attained with the use of the machine, which consists of an oblong metallic plate ending in a handle, that has on each side a series of comb teeth specially formed in various shapes and lengths of teeth. The machine can be adjusted for haircutting in various depths, or to the respective shape of the scalp or any other hairy part of the human body. The possibility of adjusting the machine, as the case may be, can be further regulated by increasing or decreasing the distance between the cutting edge of the blade and the tip of the teeth by a proportionate transposition of the cutting blade along the comb's teeth by attaching the cutting blade on a moving bearer that can be slid along the comb's teeth and also can be fixed at the desired position.

8 Claims, 27 Drawing Figures

Fig. 2a
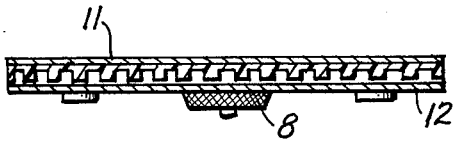
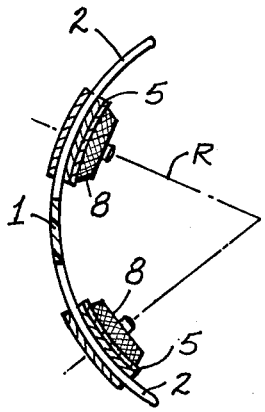
Fig. 2.
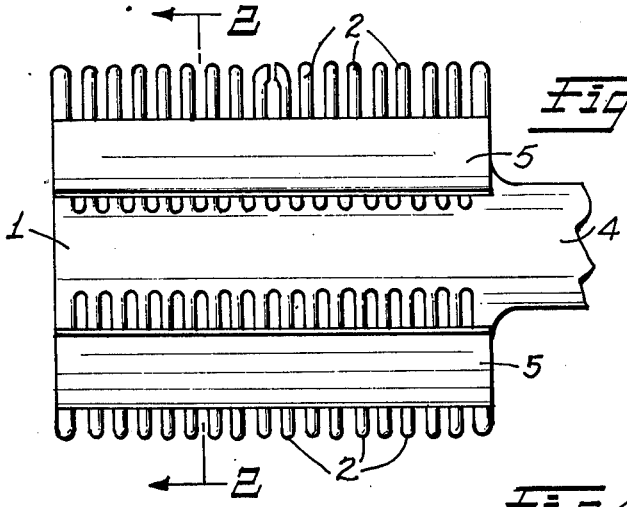
Fig. 1.
Fig. 3.
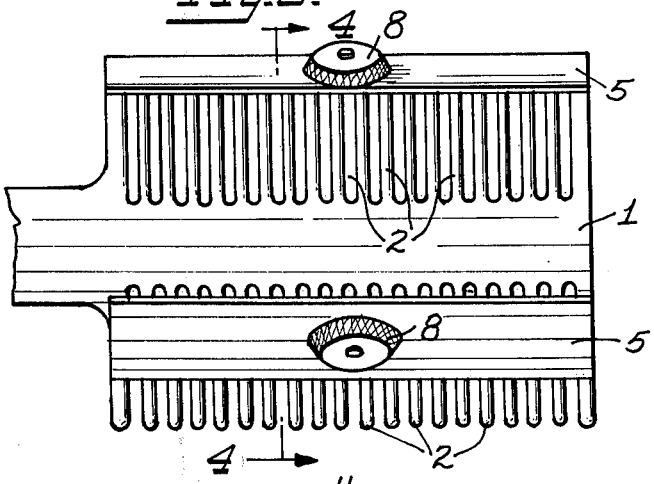
Fig. 4.
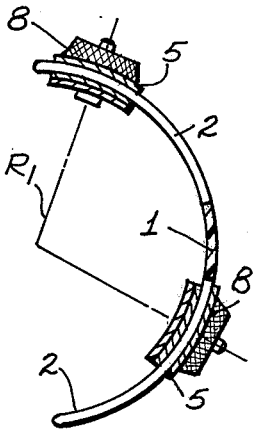
Fig. 5.
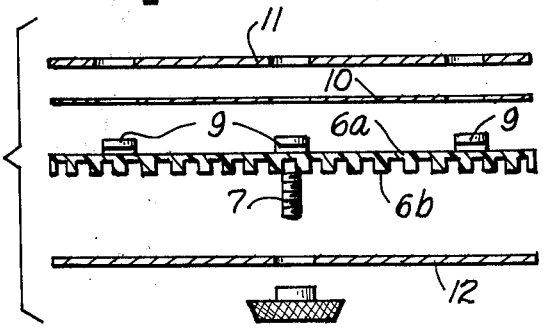
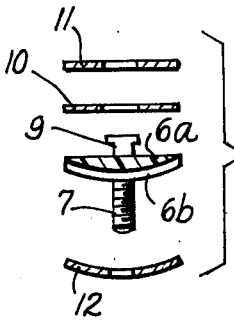
Fig. 6.
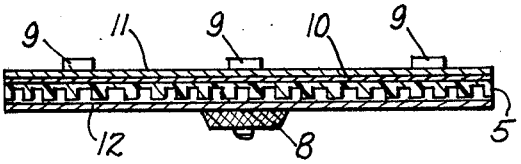
Fig. 7.

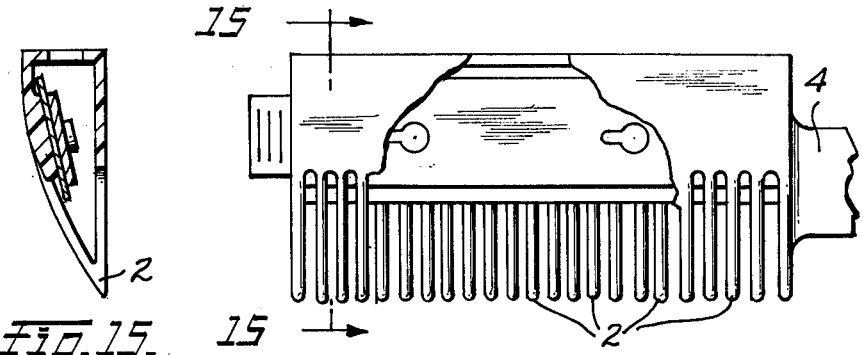
Fig. 14.
Fig. 15.
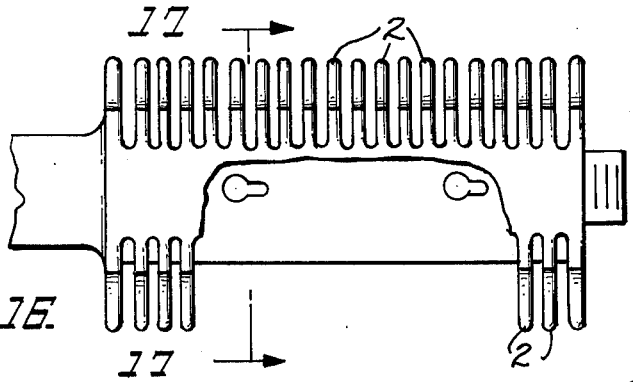
Fig. 16.
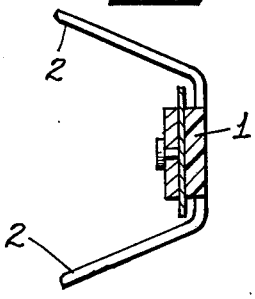
Fig. 17.
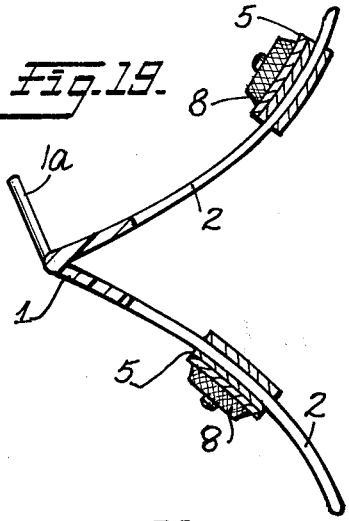
Fig. 19.
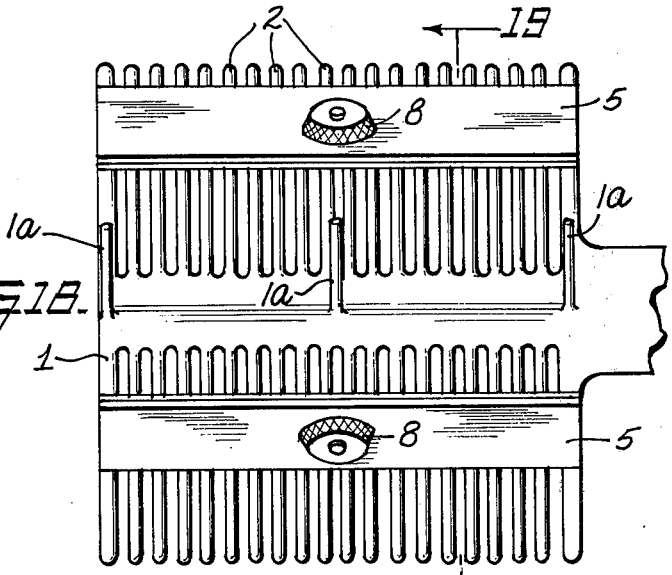
Fig. 18.
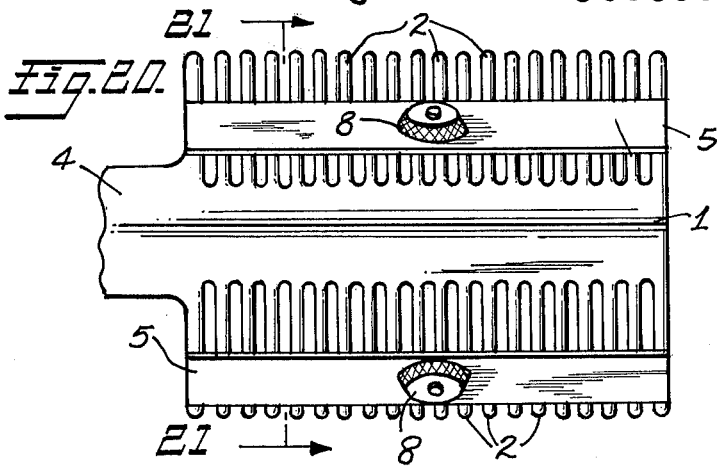
Fig. 20.
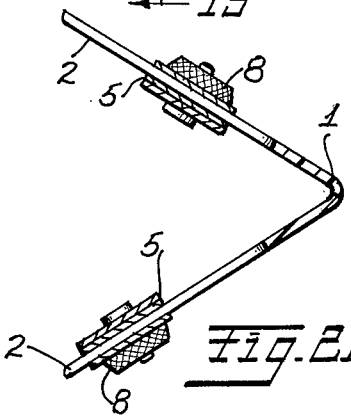
Fig. 21.

Fig. 22.
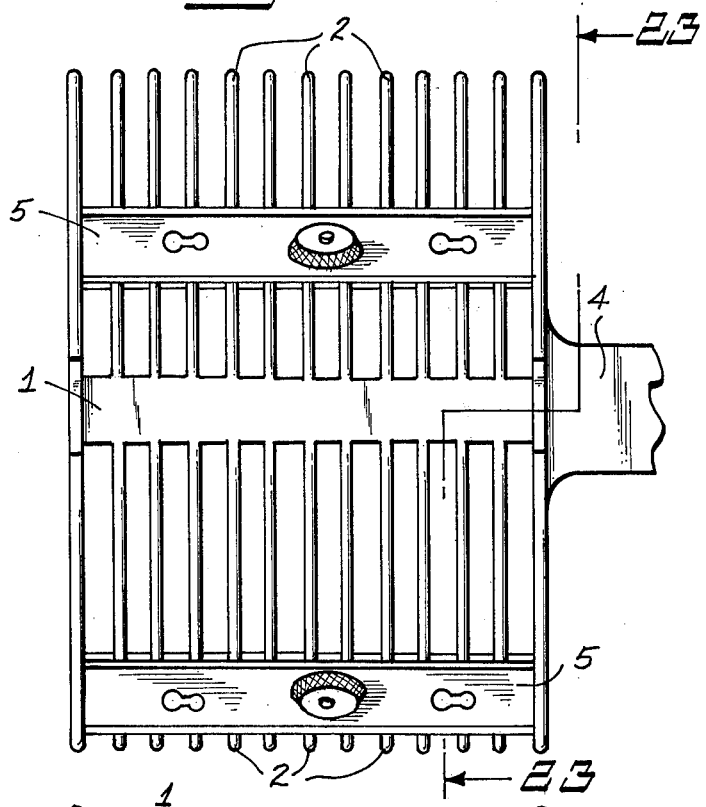
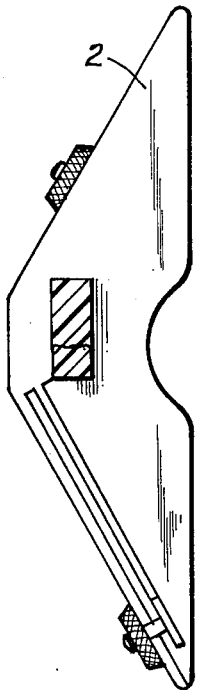
Fig. 23.
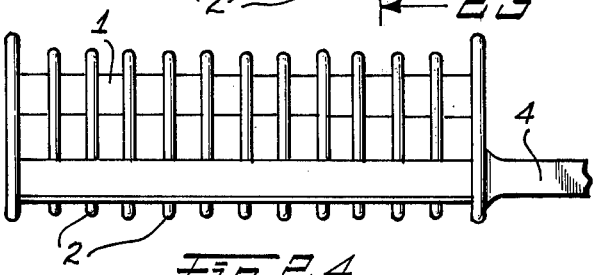
Fig. 24.
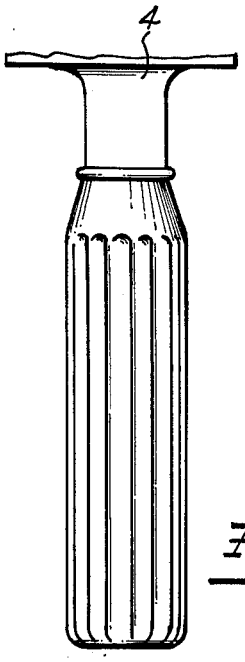
Fig. 26.
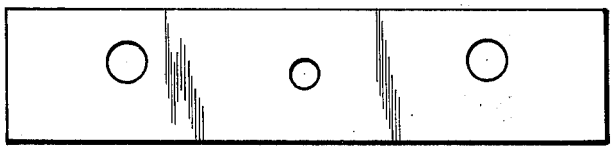
Fig. 25.

HAIRCUTTING MACHINE

This is a continuation of application Ser. No. 330,740, filed Feb. 8, 1973 and now abandoned.

The invention relates to a self-operated haircutting machine by which a haircut may be performed without the need of help from another person or a hairdresser in executing the work.

The haircut is attained with the use of the machine, which consists of an oblong metallic plate ending in a handle, that has on each side a series of comb teeth specially formed in various shapes and lengths of teeth. The machine can be adjusted for haircutting in various depths, or to the respective shape of the scalp or any other hairy part of the human body. The possibility of adjusting the machine, as the case may be, can be further regulated by increasing or decreasing the distance between the cutting edge of the used blade and the tip of the teeth by a proportionate transposition of the cutting blade along the comb's teeth by attaching the cutting blade on a moving bearer that can be slid along the comb's teeth and also can be fixed at the desired position.

Therefore, with the combination of various lengths and shapes of teeth and various distances between the edge of a cutting blade and the tips of comb's teeth, the desired depth of haircut is attained and the scope of the invention is secured for the operation of the machine by one person without need of assistance.

Up to the present various techniques have been attempted to develop a self-operated haircutting machine but, no such device has been constructed except those having combs with a fixed cutting blade and being usable only for a standard depth of haircut and particularly near the base of hair, without any possibility of adjustment or steadying it for haircutting in various heights, as may be desired and hence their use being limited only for a certain area of the hairy part of the human body.

In the drawings:

FIG. 1 shows an elevational view of the haircutting machine;

FIG. 2 shows a cross-sectional view along line 2—2 of FIG. 1;

Figure 8:
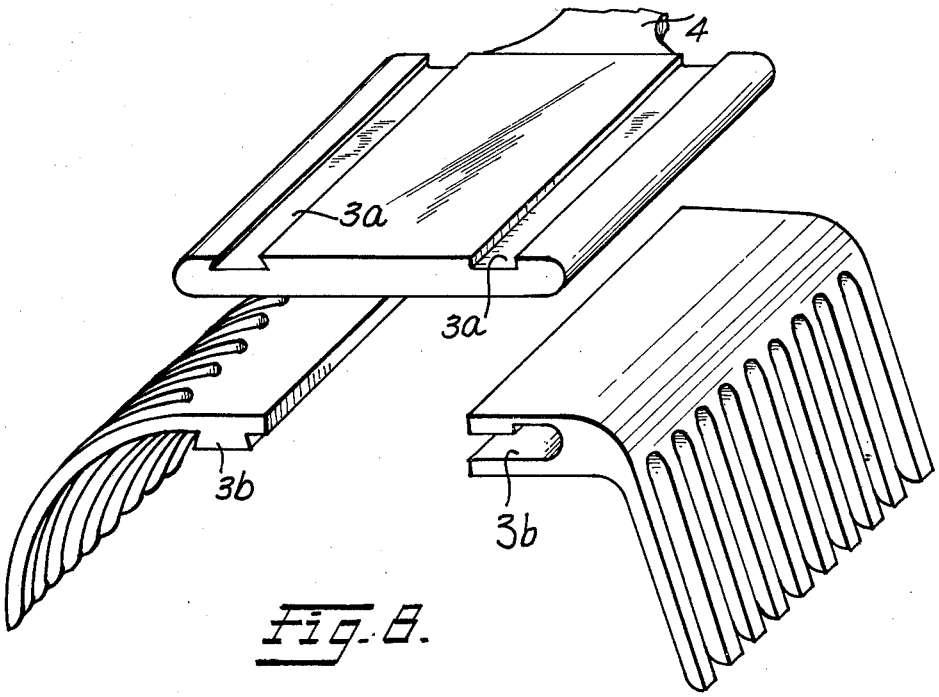
Figure 11:
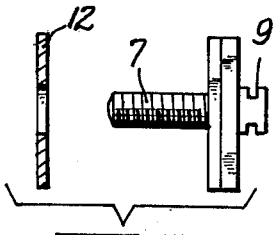
Figure 10:
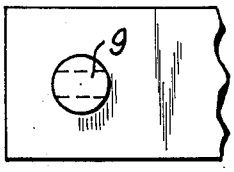
Figure 9:
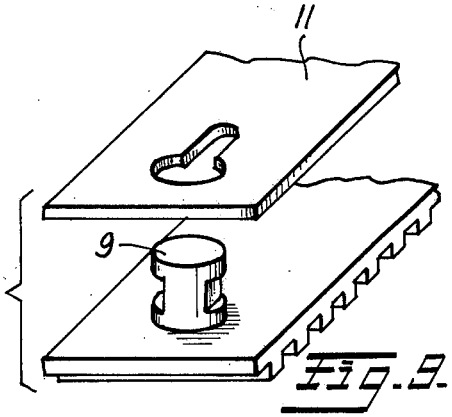
Figure 13:
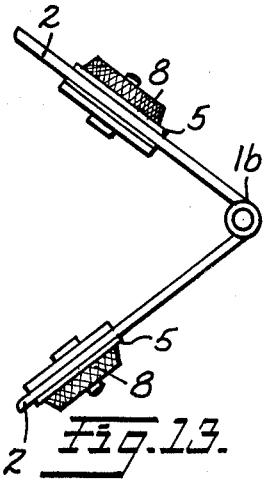
Figure 12:
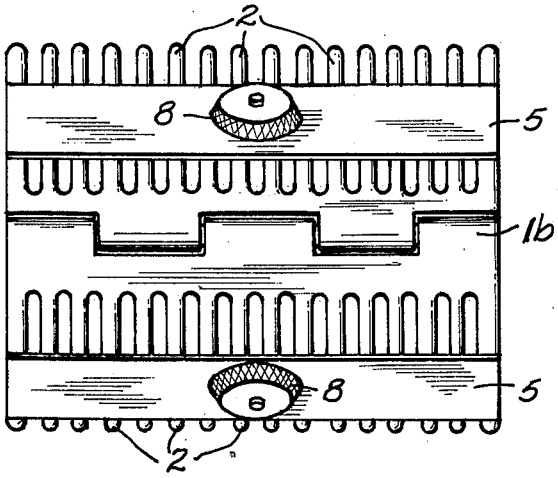

FIG. 2*a* is a section through an assembled cutting blade system which is mounted on the teeth of the comb of the haircutting machine;

FIG. 3 shows a further elevational view of the haircutting machine;

FIG. 4 shows a cross-sectional view along the line 4—4 of FIG. 3;

FIG. 5 is a longitudinal view of the cutting blade system in a dismantled condition;

FIG. 6 shows in side view the cutting blade system in a dismantled condition;

FIG. 7 shows the cutting blade system in assembled condition,

FIG. 8 shows a perspective view of a further embodiment of the haircutting machine of the invention;

FIG. 9 shows an enlarged view of a component part of the cutting blade system;

FIG. 10 shows a bottom view of the component part shown in FIG. 9;

FIG. 11 shows a side view of the component part shown in FIG. 9;

FIG. 12 shows an elevational view of a further embodiment of the haircutting machine;

FIG. 13 shows a side view of the embodiment shown in FIG. 12;

FIG. 14 shows an elevational view of a further embodiment of the haircutting machine;

FIG. 15 shows a cross-sectional view along line 15—15 of the embodiment shown in FIG. 14;

FIG. 16 shows an elevational view of a further embodiment of the haircutting machine;

FIG. 17 shows a cross-sectional view along line 17—17 of the embodiment shown in FIG. 16;

FIG. 18 shows an elevational view of a further embodiment of the haircutting machine;

FIG. 19 shows a cross-sectional view along line 19—19 of the embodiment shown in FIG. 18;

FIG. 20 shows an elevational view of a further embodiment of the haircutting machine;

FIG. 21 shows a cross-sectional view along line 21—21 of the embodiment shown in FIG. 20;

FIG. 22 shows an elevational view of a further embodiment of the haircutting machine;

FIG. 23 shows a cross-sectional view along line 23—23 of the embodiment shown in FIG. 22;

FIG. 24 shows a side view of the embodiment shown in FIG. 23;

FIG. 25 shows the cutting blade of the haircutting machine;

FIG. 26 shows the handle of the haircutting machine.

Referring now to the drawings numeral 1 indicates an oblong flat plate or bar of metallic or plastic construction, having at each of its sides a series of teeth 2 constituting either an integral part of the oblong plate 1, as shown in FIGS. 1, 14, 16, 18 and 20 or independent parts that can be secured to the sides of plate 1 by dovetail shaped tongue and groove means 3*a*, 3*b* or by slide grooves 3, 3*a* as best shown in FIG. 8. With teeth forming independent parts, different shapes or size of teeth may be secured to the oblong plate 1.

The end of bar 1 terminates either as a handle 4 as shown in FIG. 26, or constitutes the beginning of another bar for a further haircutting machine, or is so shaped as to receive any other desired device and fitting.

The cutting blade system which is adapted to slide along the whole length of the teeth of the comb comprises, a main bearer or support part which is an oblong plate having one flat side 6*a* FIG. 6) and one convex side 6*b* shaped to a radius of curvature corresponding to the teeth of the comb. On this convex surface and transversally to its long axis, there are alternate grooves and channels, corresponding in number and spacing to the teeth of the comb, these channels guiding the bearer or support part in its sliding movement along the teeth. The number of channels may be decreased or even eliminated. In an alternative embodiment as shown in FIGS. 9, 10, 11 the support plate may have a flat surface, instead of having convex surface. The groove channels are accordingly flat in this case.

A stud 7 is provided in said support plate, which passes through the space of two adjacent teeth, for clamping the support plate on the teeth, at the desired place, by means of a nut 8. In the opposite side of the bearer or support plate there are protruding pins 9 used for the insertion and fixing of a cutting blade 10. A further plate 11 is provided for the purpose of tightening the blade in place.

Stud 7 is fixed on the bearer or support plate by riveting. It may also be formed by moulding. Stud 7 has a fine pitch thread.

Nut 8 is used for tightening the support plate in the desired place and has the same female threads as the stud, also its perimeter is knurled to provide a finger-grip.

Each protruding pin 9 (quick-release button) FIG. 7, 9, 10, 11 is cylindrical and either formed by moulding integral with plate 6*a* or is fixed to plate 6*a* by riveting. It has on its cylindrical body two notches parallel to longitudinal sides of bearer plate 6*a* and opposite to each other.

The cutting blade 10, FIG. 25, has approximately the same length as the support plate with holes for the insertion of pins 9.

The retaining plate 11, is used to retain the blade on the support plate and has the same length and width as the support blade. Plate 11 also has key-holes for its locking engagement with the notches of the pins 9, FIG. 7, 9, 10, 11.

The plate 12, is fitted on the respective curved or flat surface of the comb's teeth and may have on one side some guiding bars, not shown, for insertion into the teeth gaps. Its purpose is to be used as a pressure distributing part for the pressure exerted by the nut on the teeth, FIG. 7, 9, 10, 11.

The comb of the present invention is made from any suitable material, metallic or plastic or of combined construction, in various shapes, by moulding, press forming, extrusion or any other means. The blade bearer or support plate and its parts are made from suitable metals duly machined. The handle, if there is one, can be made from different materials and may have various shapes.

As is mentioned in the general description, a wide range of use is attained by using alternatively various combs having different shapes and length and length of teeth and also by altering the distance between the cutting edge of the blade and the tip of the comb. This is achieved by using combs of different shapes, as indicatively mentioned herebelow:

a. A comb having on both sides of the oblong bar a series of teeth, the planes of which form an acute angle. The teeth can be of curved (FIG. 18) or straight shape (FIG. 21). In the apex of the oblong bar there are three short pins 1*a* (FIGS. 18 and 19) arranged at an angle, in respect to the center line of the comb's planes, for the purpose of supporting the comb on the hairy part of the human body and also to keep the machine at a constant angle of inclination during operation.

b. A comb having along the oblong bar a hinge (1*b*) FIG. 12, by which the planes of teeth on both sides can be rotate, so that the angle between them can be increased or decreased and thus, variable height of haircut can be obtained, in combination with variations in the distance of the blade from the ends of the teeth.

c. A comb having on both sides of the oblong bar a series of teeth, the planes of which form the sides of a trapezoid (FIG. 16).

d. A comb having a series of teeth arranged in a triangle as in FIG. 14. This arrangement results in a firm supporting base for the comb during operation.

e. A comb having two series of teeth on both sides of the oblong bar (FIG 23, 24), consisting from a number of parallely arranged teeth of triangular surface, with the base of the triangle touching the hairy surface during operation. In both sides of the triangle and near the edges there is a split notch in which the blade bearer slides (FIGS. 23, 24).

According to the desired height of haircut and its style, a comb of suitable shape is used and the bearer or support plate is adjusted accordingly. The machine is hand held and used as a common haircomb. By manipulating the machine to place the ends of both sets of comb teeth against one's skin the cutter is held fixed a predetermined distance from the skin and therefore from the base of the hairs, the hairs are guided through the teeth gaps where they are cut. With the arrangement of combs on both sides of the oblong bar and of the respective blade, the machine can be used from both sides by simply changing the direction of movement.

I claim:

1. A hair cutting device comprising:

a. an elongated support having a handle member extending along an axis from one end thereof;

b. a plurality of spaced, elongated comb teeth extending outwardly and downwardly from opposite sides of said support and having free ends, said teeth on one side of said support being symmetrical with and having substantially the same length as the teeth on the other side, the arrays of teeth on the opposite sides of said support defining the legs of an arch;

c. elongated blade carrier means adapted to be selectively and adjustably positioned along substantially the entire length of the teeth on either side of said support, said blade carrier means extending parallel with and being spaced from said elongated support and having a width substantially less than the length of said teeth, and including a stud passing through and slidable within the space between adjacent teeth, and a means attached to said stud for clamping said carrier on the teeth at a selected location along the length thereof; and d. a cutter blade on said carrier means, said blade having a cutting edge facing away from said support and being selectively adjustable with said carrier to different positions along said teeth from the ends thereof at the bottom of the arch legs formed by the arrays of teeth on the opposite sides of said support, to the upper ends of said teeth adjacent said support, whereby the device may be moved over a portion of the user's body with the ends of said teeth at the bottom of said arch legs slidably engaging the user's body to cut hair thereon to the length determined by the position of said blade along said teeth, said arch legs serving to hold said cutting edge a fixed distance from and in a selected position relative to said surface.

2. A device as defined in claim 1 wherein said teeth on each side of said support are curved to lie generally in the surface of an imaginary cylinder, and said carrier means is slidably adjustable along said teeth, said curved teeth being effective to mount said cutter blade at selectively different cutting angles lying in a plane tangential to the surface of said imaginary cylinder, depending upon where said carrier blade is positioned along the height of said arch legs.

3. A device as defined in claim 1 wherein said support and the teeth extending therefrom are shaped to define a device of V-shape in section with the apex thereof extending generally centrally along said support.

4. A device as defined in claim 3 wherein said support comprises two portions hinged together along said apex whereby to change the angle of said V-shape.

5. A device as defined in claim 1 wherein each of said teeth is of generally triangular shape as viewed from an end of said support; slots through said teeth; said carrier and blade being slidable along said slots.

6. A device as defined in claim 1 wherein said teeth on each side lie generally in the surface of planes lying on inclined angles relative to said support and the axis of said handle.

7. A device defined in claim 1 wherein said blade carrier means includes a plurality of blade positioning studs fixed thereto and extending through corresponding openings in said cutting blade, said studs having notches formed therein, and a support plate substantially the same length and width of said blade having key-holes therein for locking engagement with said notches.

8. A hair cutting device comprising:

a. an elongated support having a handle member extending along an axis from one end thereof;

b. a plurality of removably mounted comb teeth extending outwardly and downwardly from opposite sides of said support and having free ends, said teeth on one side being symmetrical with the teeth on the other side, and the teeth on each side being carried by a common member removably mounted on said support;

c. blade carrier means selectively and adjustably positioned along substantially the entire length of the teeth on either side of said support, said blade carrier means including a stud passing through and slidable within the space between adjacent teeth, and a means attached to said stud for securing said carrier on the teeth; and d. a cutter blade on said carrier means, said blade having a cutting edge facing away from said support and being selectively adjustable with said carrier to different distances from the ends of said teeth, including inwardly of the ends thereof, whereby the device may be moved over a portion of the user's body with the ends of all said teeth on at least one side of said support slidably engaging the user's body to cut hair thereon to the length determined by the position of said blade along said teeth and hold said cutting edge a fixed distance from said surface.

* * * * *